United States Patent [19]

Campbell

[11] 3,987,714

[45] Oct. 26, 1976

[54] BUILDING CONSTRUCTION

[75] Inventor: Henry Fred Campbell, Belleville, Mich.

[73] Assignee: Campbell Research Corporation, Detroit, Mich.

[22] Filed: May 22, 1975

[21] Appl. No.: 580,065

Related U.S. Application Data

[63] Continuation of Ser. No. 452,751, March 20, 1974, abandoned.

[52] U.S. Cl. ..... 98/40 D; 52/220; 52/303

[51] Int. Cl.[2] ..... F24F 7/04

[58] Field of Search ..... 98/40 D, 40 R, 40 C, 98/33 A, DIG. 6; 52/303, 220, 263, 173, 221

[56] References Cited

UNITED STATES PATENTS

| | | | |
|---|---|---|---|
| 2,221,001 | 11/1940 | Lucius | 98/40 D |
| 2,251,682 | 8/1941 | Loadbetter | 98/40 D |
| 2,291,220 | 7/1942 | Germonprez | 98/40 D |
| 2,569,910 | 10/1951 | Venuti | 52/221 |
| 2,596,300 | 5/1932 | Smith | 237/69 |
| 2,916,261 | 12/1959 | Parkinson et al. | 98/40 D |
| 2,988,980 | 6/1961 | Tschudin | 98/40 D |
| 3,353,472 | 11/1967 | Lee et al. | 98/40 D |
| 3,488,905 | 1/1970 | Campbell | 52/263 |

*Primary Examiner*—William E. Wayner
*Assistant Examiner*—Henry C. Yuen
*Attorney, Agent, or Firm*—Barnes, Kisselle, Raisch & Choate

[57] ABSTRACT

A building construction comprising at least one longitudinally extending beam, a plurality of spaced parallel beams extending transversely of and fastened to said longitudinally extending beam, and a plurality of panels extending between adjacent transverse beams in side-by-side relationship. Means are associated with at least one of the transverse beams and define a duct for the passage of air. The panels have openings therethrough communicating with the duct such that air passing through said duct may pass downwardly and inwardly to the interior of the building.

18 Claims, 10 Drawing Figures

BUILDING CONSTRUCTION

This is a continuation of application Ser. No. 452,751, filed Mar. 20, 1974, now abandoned.

This invention relates to buildings and particularly to commercial buildings.

BACKGROUND OF THE INVENTION

In designing and erecting buildings, it is conventional to utilize spaced beams over which decking is applied and thereafter roofing is applied to provide the roof of the building. In such buildings, the heating and ventilating is usually added to the interior of the building.

Among the objects of the invention are to provide a building construction wherein substantial loads can be supported with minimum use of columns; wherein the heating and ventilating system can be incorporated in the roof structure; and which utilizes modular prefabricated type building components so that a minimum amount of labor is needed in the field.

SUMMARY OF THE INVENTION

In accordance with the invention, a plurality of spaced parallel beams are provided, and a plurality of panels extending between adjacent transverse beams in side-by-side relationship. Means are associated with at least one of the said beams and define a duct for the passage of air. The panels having openings therethrough communicating with said duct such that air passing through said duct may pass downwardly and inwardly to the interior of the building. In another form, a longitudinally extending beam overlies the parallel beams transversely thereof and is fastened to the parallel beams.

DESCRIPTION

Figure 1:
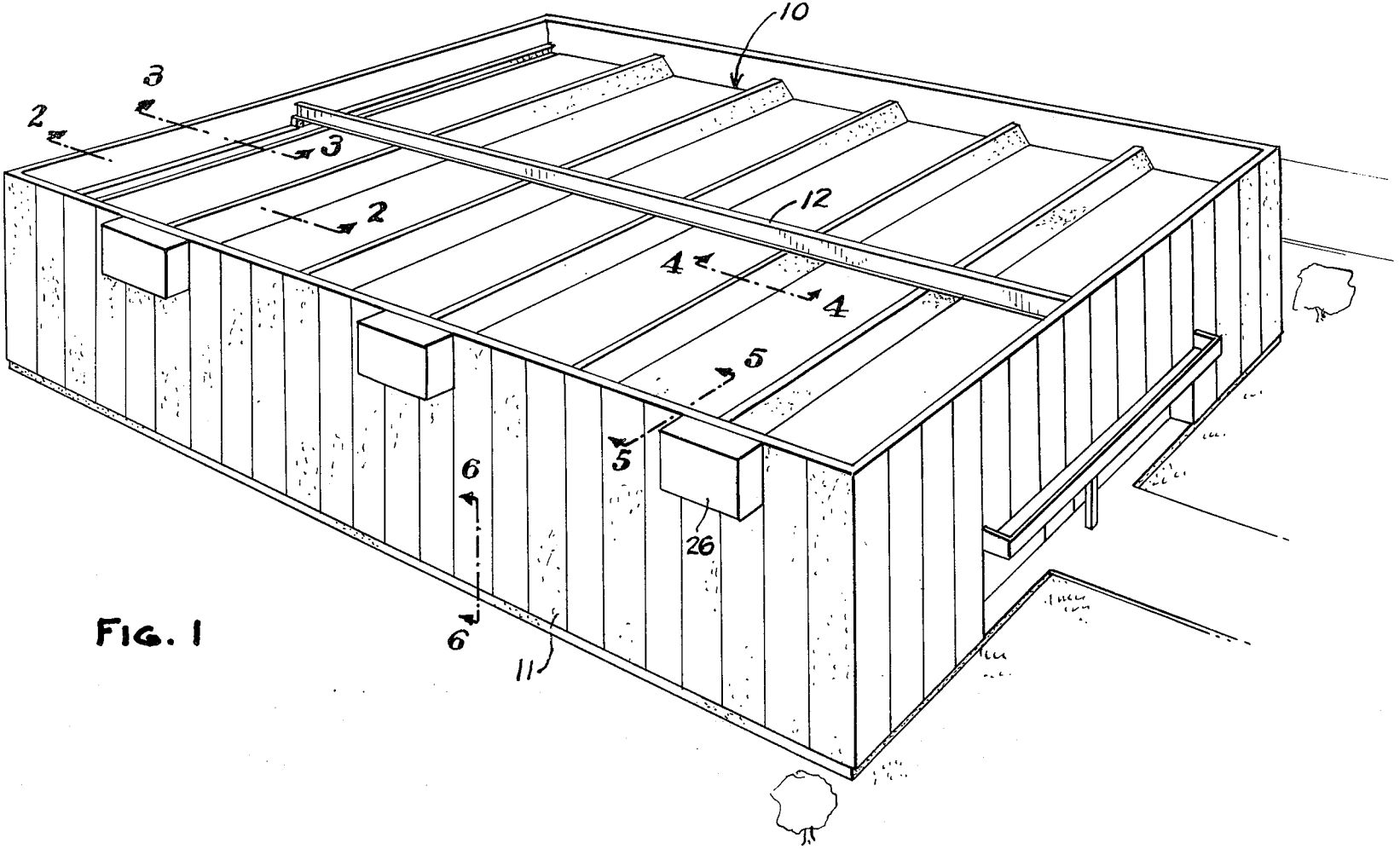
FIG. 1 is a perspective view of a building embodying the invention.

Referring to FIG. 1, the building embodying the invention is particularly adapted for commercial use wherein high ceilings are desired and open spaces are preferred and comprises a roof structure 10 supported by a frame or wall, as presently described, and having side walls 11 made of prefabricated panels or the like.

Figure 9:
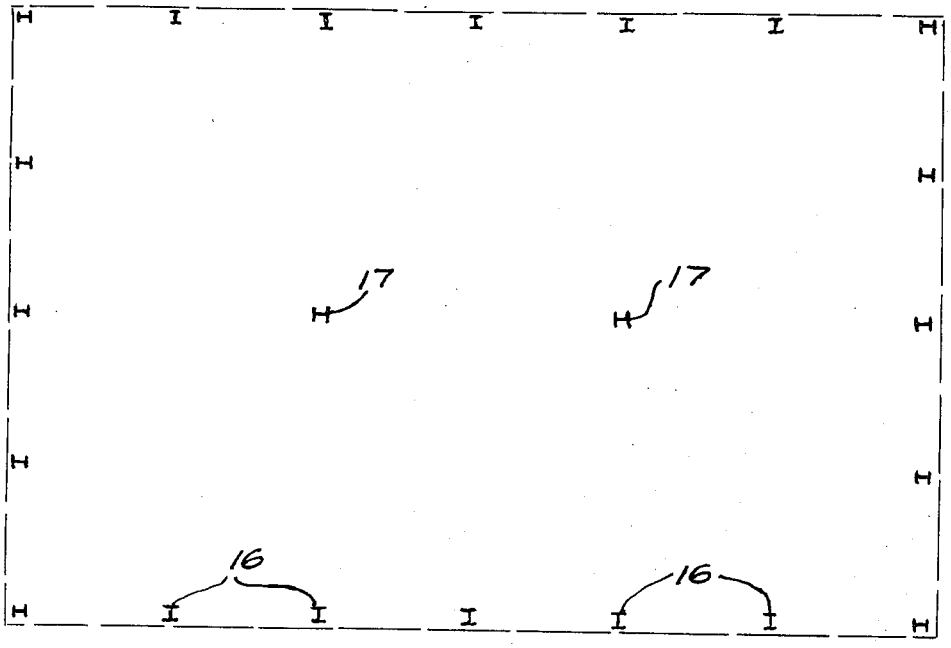
FIG. 9 is a diagrammatic view showing the position of the columns in one form of the invention.

Referring to FIGS. 2–6, the roof structure includes a longitudinally extending external beam 12 that is exposed and a plurality of transversely extending parallel beams 13 underlying and connected to the external beam 12 by bolts 14 and insulated therefrom by insulator blocks **15, 15*a*. The roof frame thus formed is supported by columns 16 along the periphery and columns 17 at points within the periphery (FIG. 9). Cross beams 18 are provided between the ends of transverse beams 13 (FIG. 7). A plurality of prefabricated panels 20 extend between the lower webs 13*a* of adjacent transverse beams 13. Each panel 20 has a length greater than its width and the length of the panel extends between the transverse beams 13. Each panel 20 includes an upper sheet 21, a lower sheet 22 and spaced truss members 23 connected between the sheets. The truss members extend lengthwise of the panels. The lower sheet 22 is preferably formed with a plurality of spaced openings 24 for purposes presently described. The sheets 21, 22 and truss members 23 are preferably made of metal. Each truss member 23 preferably comprises channels 23*a*, between which an undulation truss 23*b*** extends.

Figure 2:
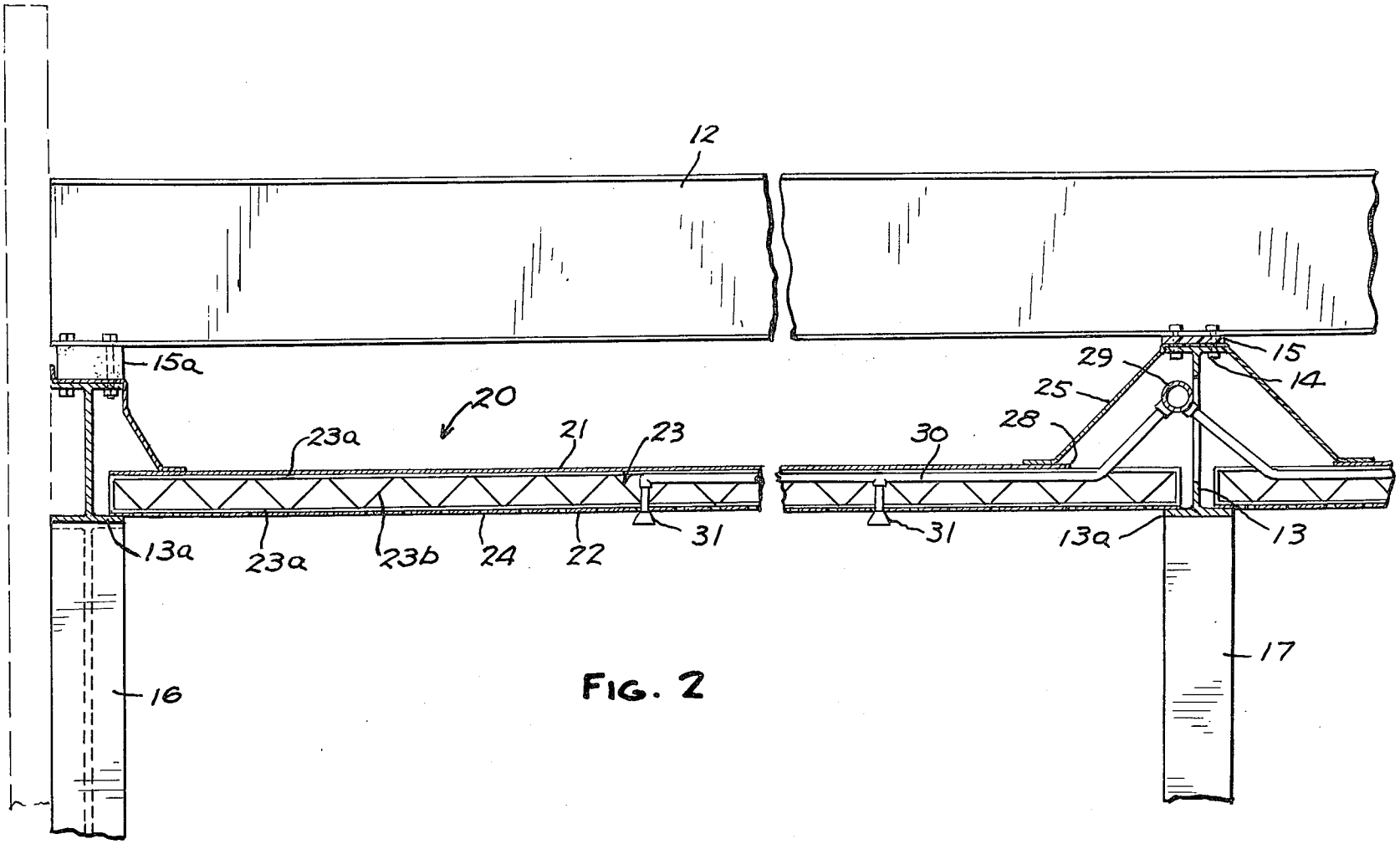
FIG. 2 is a fragmentary sectional view on an enlarged scale taken along the line 2—2 in FIG. 1.
Figure 3:
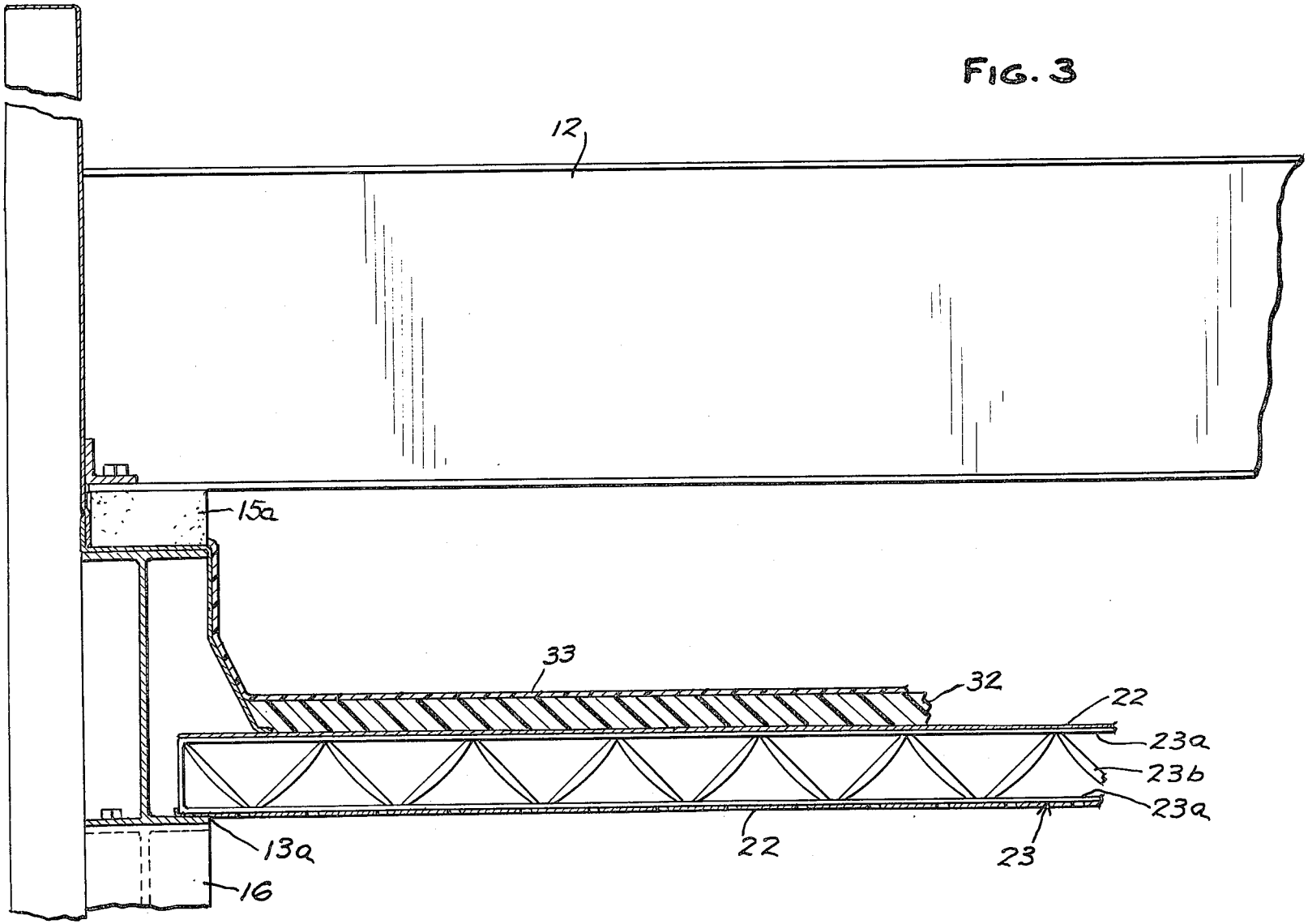
FIG. 3 is a fragmentary sectional view on an enlarged scale of a portion of the structure shown in FIG. 2.
Figure 4:
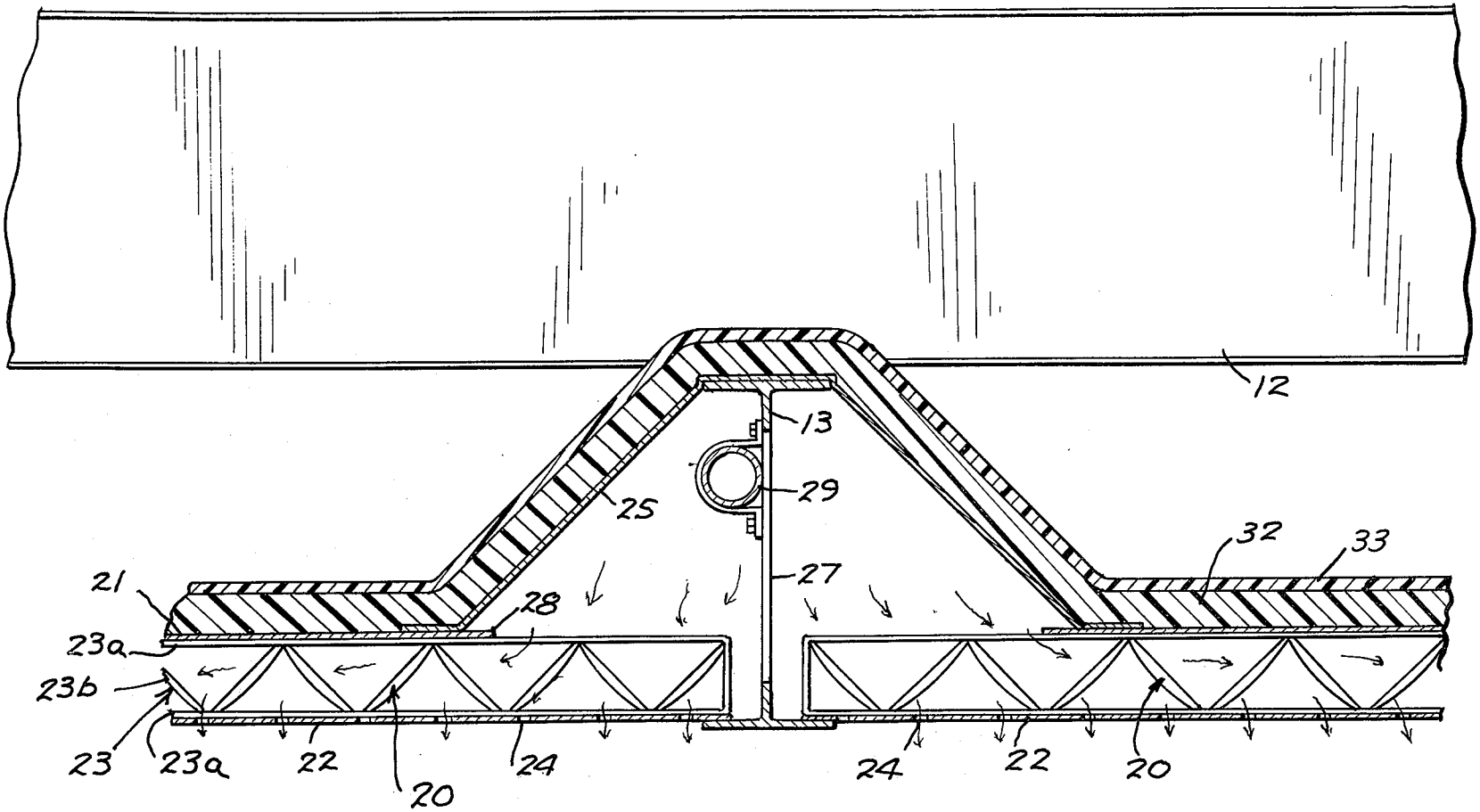
FIG. 4 is a fragmentary sectional view on an enlarged scale taken along the line 4—4 in FIG. 1.
Figure 5:
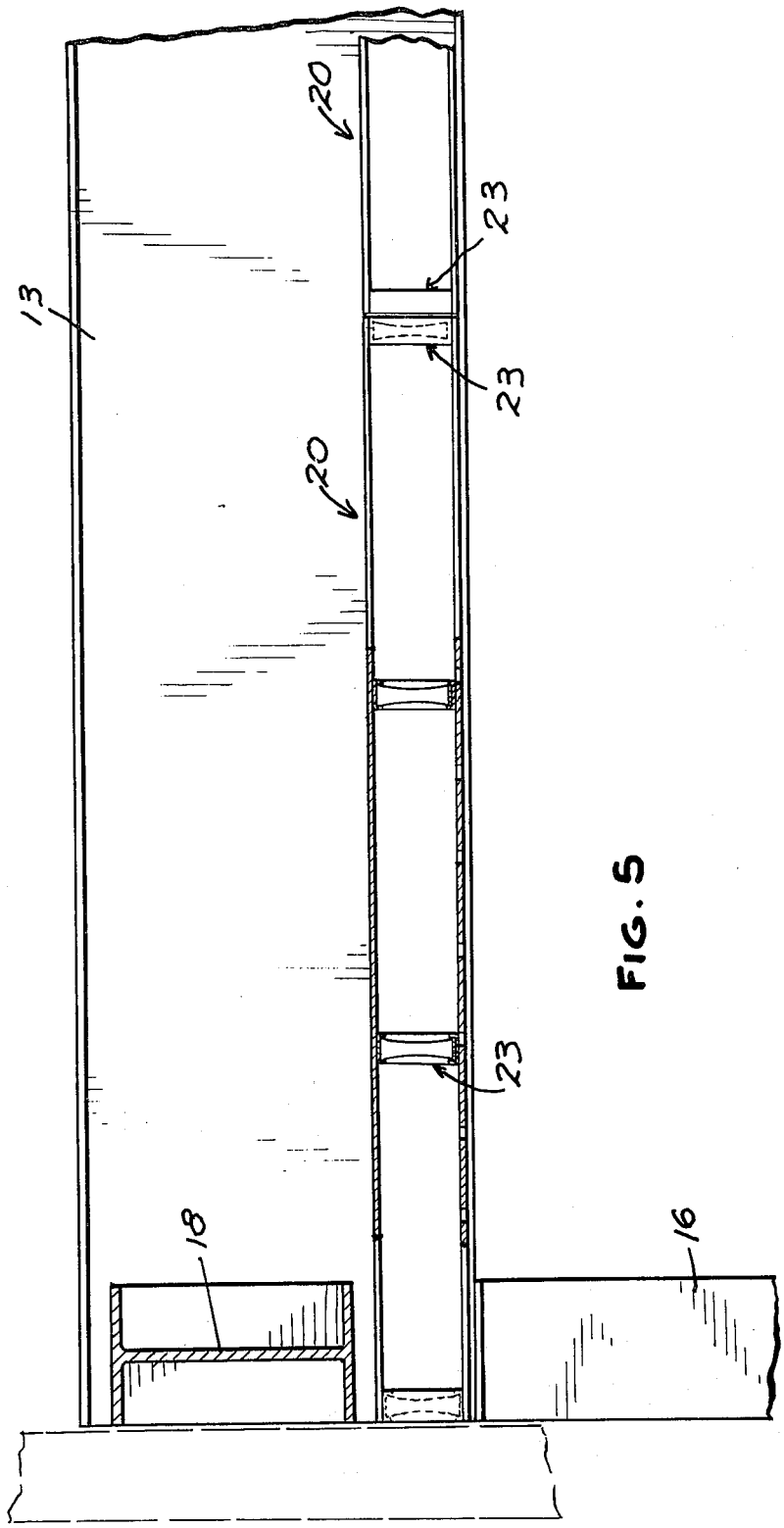
FIG. 5 is a fragmentary sectional view on an enlarged scale taken along the line 5—5 in FIG. 1, parts being broken away.
Figure 6:
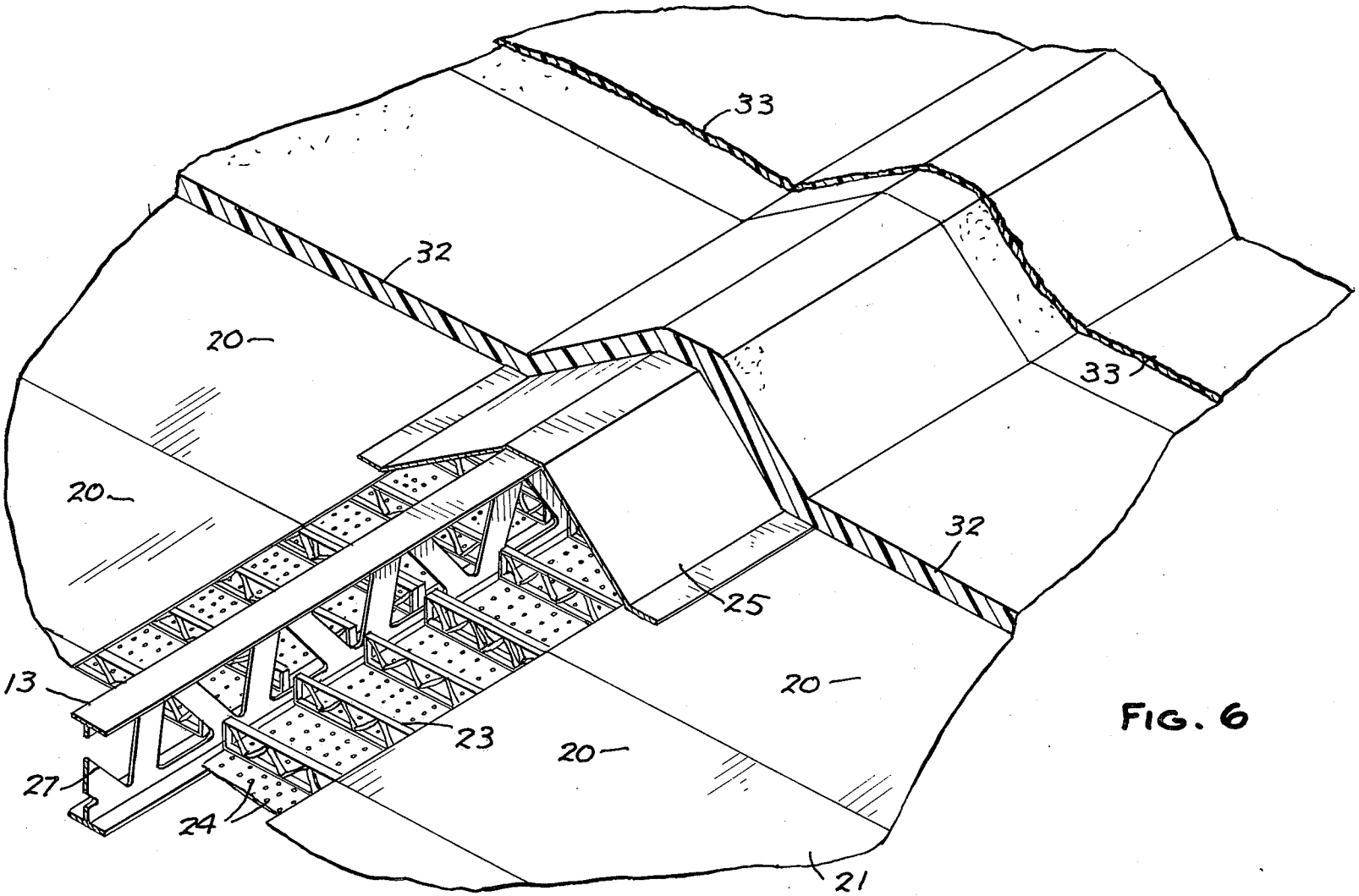
FIG. 6 is a part sectional fragmentary perspective view of a portion of the roof construction.
Figure 7:
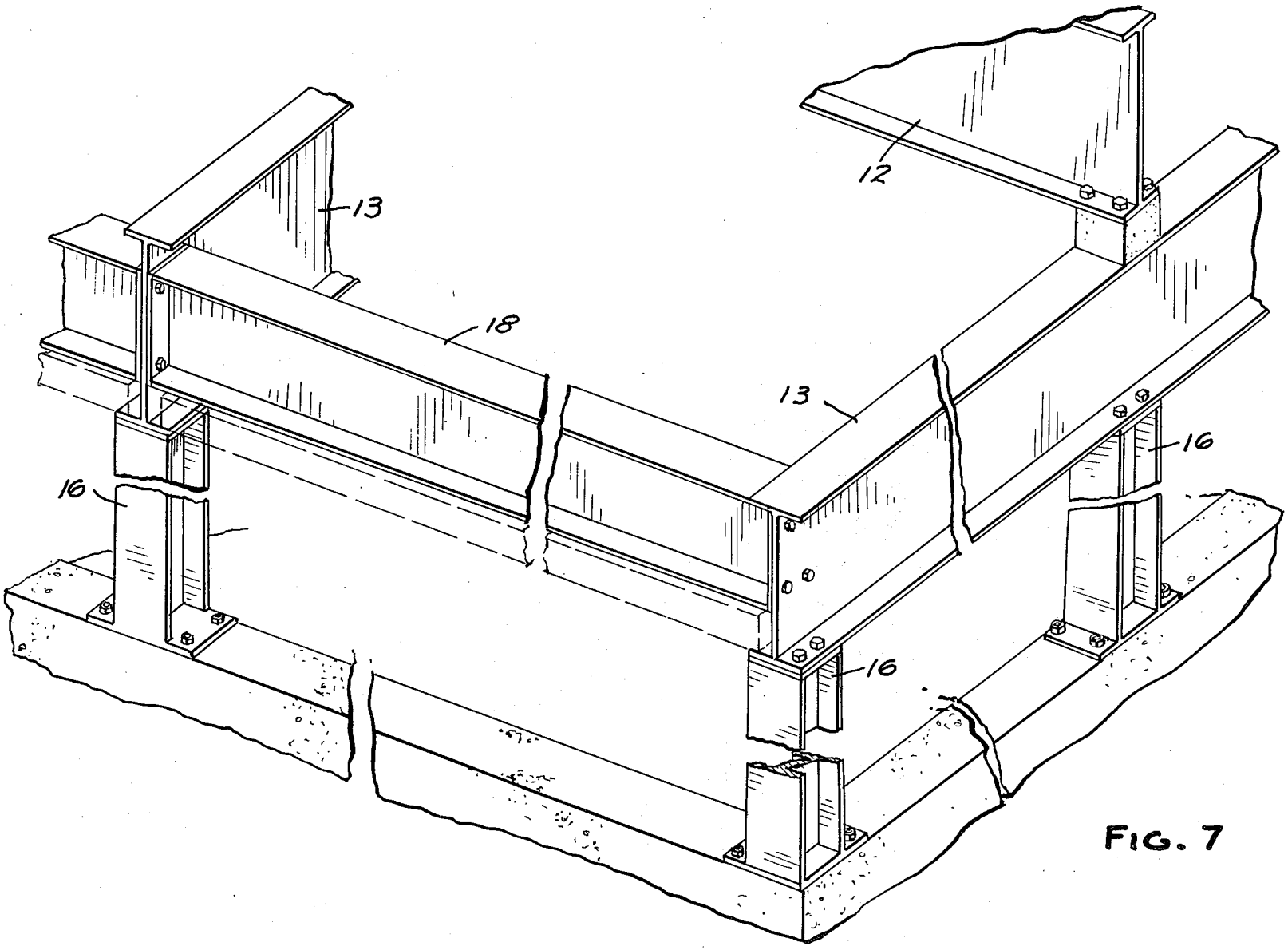
FIG. 7 is a fragmentary part sectional view of a portion of the frame of the building.

Referring to FIGS. 2, 4 and 6, a duct is provided along each transverse beam 13 and is formed by a sheet metal cap 25. Heating and ventilating air from units 26 suspended on the exterior of the building is directed through the duct 25. In order to produce a uniform plenum effect, the beam 13 is preferably provided with spaced openings 27 to permit free passage of air from one side to the other of the beam. Portions of the top sheet 21 of each panel 20 are cutaway or of reduced length as at 28 so that air may freely pass from the duct between the sheets 21, 22 and then downwardly through the openings 24 into the interior of the building thereby heating or cooling the building.

In addition, other utilities may be provided in the duct such as a sprinkler supply pipe 29 extending longitudinally of the duct and having service pipes 30 connected thereto and extending between the sheets of the panels to discharge heads 31 (FIG. 2). The duct not only provides a space for the sprinkler pipe 29 but additionally functions to maintain the pipe sufficiently warm to prevent freezing of any water in the sprinkler pipe.

Referring to FIGS. 4 and 6, the roofing material may be provided over the panels 20 and the duct plate 25 and preferably comprises a sprayed-on coating of polyurethane as at 32 which is in turn protected by a second coating 33 of silicone.

The position of the columns 16, 17 is shown in FIG. 9.

Figure 8:
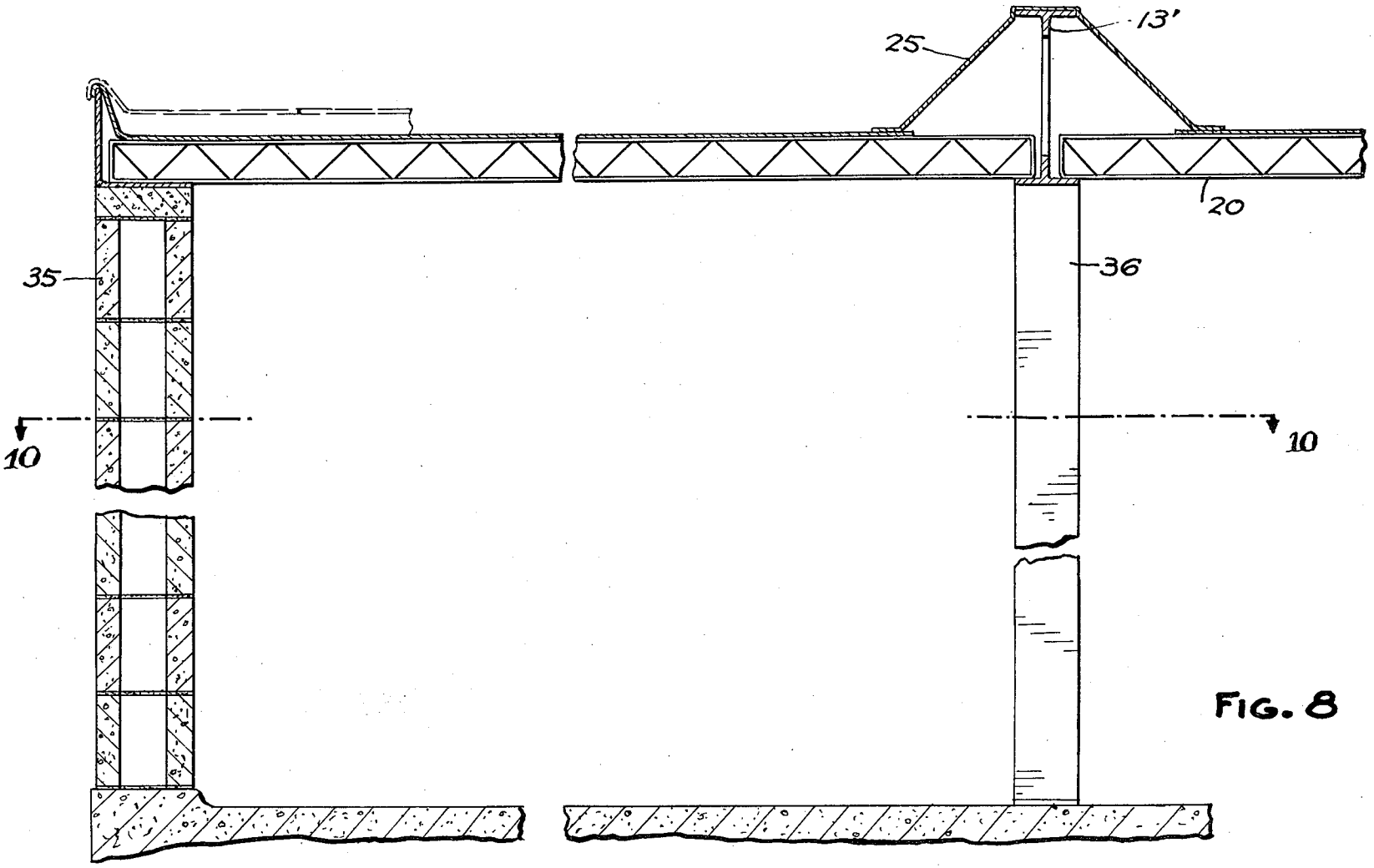
FIG. 8 is a fragmentary vertical sectional view through a modified form of the invention.
Figure 10:
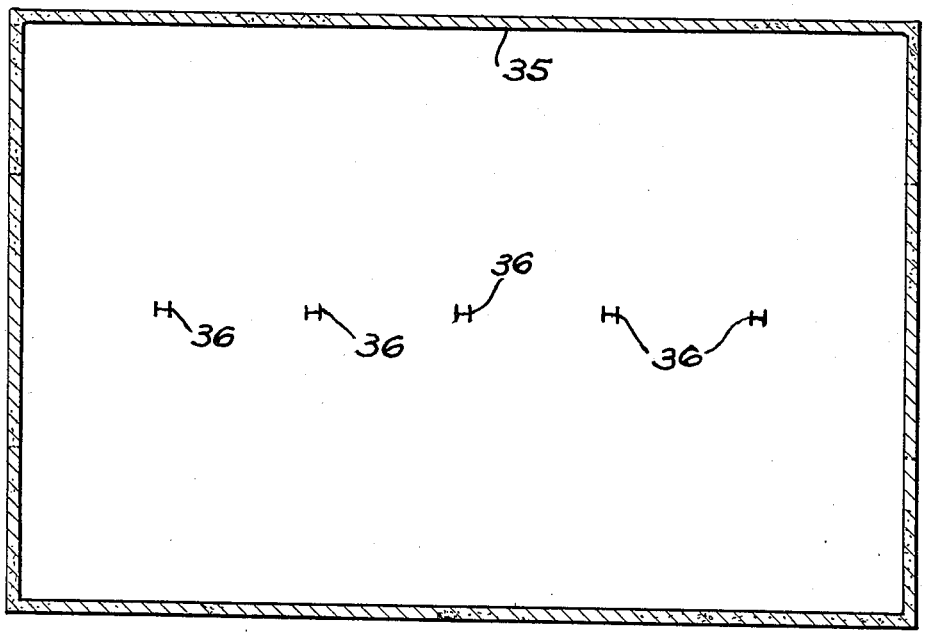
FIG. 10 is a diagrammatic view showing the position of the columns in another form of the invention.

In the modified form of the invention shown in FIGS. 8 and 10, the external beam is omitted and only transverse beams 13′ are provided. In addition, the ends of the panels extending to the outermost edge of the building are supported by a masonry wall structure 35. In this form columns 36 are provided at spaced points along the length of each beam 13′.

I claim:

1. In a building construction, the combination comprising at least one generally horizontal longitudinally extending beam, a plurality of spaced parallel beams extending horizontally and transversely of and fastened to said longitudinally extending beam, means for supporting said transversely extending beams in said building such that they support said longitudinally extending beam, and a plurality of panels extending between said transverse beams, the length of said panels being greater than the width of said panels and the length of said panels extending between transverse beams, means associated with at least one of said transverse beams and defining a duct enclosing said transverse beam for the passage of air, said panels having opening therethrough communicating with said duct such that air passing through said duct may pass downwardly and inwardly to the interior of the building, said panels comprising spaced sheets and truss members interposed between said sheets, one of said sheets facing externally and the other internally of the building, portions of said external sheet terminating in spaced relation to the end of the panel such as to provide direct communication with said duct, the internal sheet having a plurality of openings therein for the passage of air, said truss members extending longitudinally of said panels.

2. The combination set forth in claim 1 wherein said sheets and said truss members are made of metal.

3. The combination set forth in claim 1 wherein said one transverse beam has a plurality of longitudinally spaced openings therethrough whereby air in said duct may pass freely between opposite sides of said beam.

4. The combination set forth in claim 1 including a layer of insulating material over said panels and said transverse beams and underlying said longitudinal beam.

5. The combination set forth in claim 4 including means for insulating said longitudinally extending beam from said transverse beams.

6. The combination set forth in claim 1 wherein said means supporting said transverse beams comprises a plurality of columns for supporting said transverse beams.

7. The combination set forth in claim 1 including a peripheral wall supporting the ends of said transverse beam.

8. In a building construction, the combination comprising a plurality of spaced parallel beams extending generally horizontally, means for supporting said beams, and a plurality of panels extending between said beams, the length of said panels being greater than the width of said panels and the length of said panels extending between transverse beams, means associated with at least one of said beams and defining a duct enclosing said beam for the passage of air, said panels having openings therethrough communicating with said duct such that air passing through said duct may pass downwardly and inwardly to the interior of the building, said panels comprising spaced sheets and truss members interposed between said sheets, one of said sheets facing externally and the other internally of the building, portions of said external sheet terminating in spaced relation to the end of the panel such as to provide direct communication with said duct, the internal sheet having a plurality of openings therein for the passage of air, said truss members extending longitudinally of said panels.

9. The combination set forth in claim 8 wherein said sheets and said truss members are made of metal.

10. The combination set forth in claim 8 wherein said one beam has a plurality of longitudinally spaced openings therethrough whereby air in said duct may pass freely between opposite sides of said beam.

11. The combination set forth in claim 8 including a layer of insulating material over said panels and said transverse beams.

12. The combination set forth in claim 8 wherein said means supporting said beams comprises a plurality of columns for supporing said beams.

13. The combination set forth in claim 8 including a peripheral wall supporting the ends of said transverse beam.

14. In a building construction, the combination comprising at least one generally horizontal longitudinally extending beam, a plurality of spaced parallel beams extending horizontally and transversely of and fastened to the underside of said longitudinally extending beam, means for supporting said transversely extending beams in said building such that they support said longitudinally extending beam, and a plurality of panels extending between said transverse beams, the length of said panels being greater than the width of said panels and the length of said panels extending between transverse beams, means associated with said transverse beams and difining a duct for the passage of air, said panels having openings therethrough communicating with said duct such that air passing through said duct may pass downwardly and inwardly to the interior of the building, said panels comprising spaced sheets and truss members interposed between said sheets, one of said sheets facing externally and the other internally of the building, portions of said external sheet terminating in spaced relation to the end of the panel such as to provide direct communication with said duct, the internal sheet having a plurality of openings therein for the passage of air, said truss members extending longitudinally of said panels.

15. The combination set forth in claim 14 wherein said sheets and said truss members are made of metal.

16. The combination set forth in claim 15 wherein said transverse beams which have ducts associated therewith have a plurality of longitudinally spaced openings therethrough whereby air in said duct may pass freely between opposite sides of said beam.

17. The combination set forth in claim 16 including a layer of insulating material over said panels and said transverse beams.

18. The combination set forth in claim 17 including means insulating said longitudinally extending beam from said transverse beams.

* * * * *